US010669666B2

(12) United States Patent
Jang et al.

(10) Patent No.: US 10,669,666 B2
(45) Date of Patent: Jun. 2, 2020

(54) DOOR UNIT AND CLOTHES TREATING APPARATUS HAVING THE SAME

(71) Applicant: Samsung Electronics Co., Ltd., Suwon-si (KR)

(72) Inventors: Jong-hyun Jang, Seoul (KR); Myung-won Jeon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 106 days.

(21) Appl. No.: 15/841,973

(22) Filed: Dec. 14, 2017

(65) Prior Publication Data

US 2018/0187363 A1 Jul. 5, 2018

(30) Foreign Application Priority Data

Jan. 3, 2017 (KR) ..... 10-2017-0000593

(51) Int. Cl.
*D06F 39/14* (2006.01)
*D06F 58/04* (2006.01)
*D06F 58/20* (2006.01)

(52) U.S. Cl.
CPC ..... *D06F 39/14* (2013.01); *D06F 58/04* (2013.01); *D06F 58/20* (2013.01)

(58) Field of Classification Search
CPC ..... D06F 39/14; D06F 58/04; D06F 58/20
See application file for complete search history.

(56) References Cited

U.S. PATENT DOCUMENTS 4,679,277 A 7/1987 Shibata
5,546,773 A * 8/1996 Lee ..... D06F 39/14 160/188
5,724,837 A 3/1998 Shin
5,903,120 A * 5/1999 Shin ..... D06F 39/14 220/263
9,340,915 B2 5/2016 Kim et al.
(Continued)

FOREIGN PATENT DOCUMENTS

CN 202208843 5/2012
CN 203429450 2/2014
(Continued)

OTHER PUBLICATIONS

International Search Report and Written Opinion of the International Searching Authority dated Feb. 9, 2018 in International Patent Application No. PCT/KR2017/013460.
(Continued)

*Primary Examiner* — Benjamin L Osterhout
(74) *Attorney, Agent, or Firm* — Staas & Halsey LLP

(57) ABSTRACT

A folder type door unit and a clothes treating apparatus having the same are provided. The clothes treating apparatus includes a main body in which an internal space configured to receive clothes is formed and a door unit configured to open and close an opened upper portion of the internal space. The door unit includes a first door rotatably disposed about a first hinge shaft with respect to the main body, a second door coupled to the first door and configured to be rotatable about a second hinge shaft with respect to the first door, and a damper configured to press the second door to a second direction opposite to a first direction in response to the second door being rotated to the first direction with respect to the first door.

15 Claims, 13 Drawing Sheets

(56) References Cited

U.S. PATENT DOCUMENTS

| | | | |
|---|---|---|---|
| 9,605,372 | B2 | 3/2017 | Kim et al. |
| 10,450,687 | B2 | 10/2019 | Kim et al. |
| 2006/0086151 | A1 | 4/2006 | Kim et al. |
| 2015/0076977 | A1 | 3/2015 | Kim et al. |
| 2015/0252508 | A1 | 9/2015 | Kim et al. |
| 2015/0267337 | A1 | 9/2015 | Kim et al. |
| 2020/0048811 | A1 | 2/2020 | Kim et al. |

FOREIGN PATENT DOCUMENTS

| | | |
|---|---|---|
| CN | 104452199 | 3/2015 |
| CN | 204608444 | 9/2015 |
| CN | 105189847 | 12/2015 |
| JP | 9-316948 | 12/1997 |
| JP | 2000-342893 | 12/2000 |
| KR | 10-2006-0077267 | 7/2006 |

OTHER PUBLICATIONS

Chinese Office Action dated Jan. 14, 2020 in Chinese Patent Application No. 201711363821.1.

* cited by examiner

DOOR UNIT AND CLOTHES TREATING APPARATUS HAVING THE SAME

CROSS-REFERENCE TO RELATED APPLICATIONS

This application claims priority from Korean Patent Application No. 10-2017-0000593, filed on Jan. 3, 2017, in the Korean Intellectual Property Office, the disclosure of which is incorporated herein by reference in its entirety.

BACKGROUND OF THE INVENTION

Field of the Invention

Apparatuses and methods consistent with exemplary embodiments relate to a door unit and a clothes treating apparatus having the same, and more particularly, to a folder type door unit having a non-exposed hinge part and a clothes treating apparatus having the same.

Description of the Related Art

In general, in using of top loading type clothes treating apparatuses, the user may work in relatively comfortable posture without bending of the waist of the user by opening a door in an upper side of a main body and inserting clothes into a washing tub or taking out the clothes from the washing tub.

A door configured to open the inside of the top loading type clothes treating apparatus is installed in a top of a main body in the top loading type clothes treating apparatus. The door is rotatably attached to the main body and in response to the door being lifted toward an upper side of the clothes treating apparatuses by gripping a handle formed in the door by the user, the door rotates and opens the inside of the main body.

As the sizes of the clothes treating apparatuses are increased to wash or dry clothes having various sizes and volumes, the size of the door is also increased.

In response to the large-sized door being opened by the user, the user grips the handle formed in the door and pulls the door upward and thus the door rotates about a fixed shaft.

In response to the door being rotated at a certain angle or more, the handle gets out of a distance that the hand of the user reaches and thus it is difficult for the user to control the door.

To prevent the handle from being missed, folder type doors of which portions are folded have been researched The portion of folder type door is configured to be folded through a hinge element and the hinge element configured to constitute an outer appearance of the door is attached to the outer surface of the door. Accordingly, the hinge element is exposed to the outside of the clothes treating apparatus. The exposed hinge element is a factor which degrades the merchantability by conveying the impression that the door configuration is complicated when viewed from the viewpoint of the product design and degrading the aesthetic sense A hinge applied to the folder type door unit that two doors are folded in the related art may simply function only to couple the two doors and may not control the folding speed of the two doors.

Accordingly, the folder type door unit gives a feeling that a door of the two doors installed in a front end is hanging and dangling on a door disposed in the rear end and thus the folder type door may give a cheap product image to the consumers.

In response to the door being opened in the folder type door unit in the related art, the front door may rotate downward at a fast speed through weight and is folded. Accordingly, this may stress the hinge structure which couples the front door and the rear door and the user is hit by the front door and result in physical injury.

SUMMARY OF THE INVENTION

Exemplary embodiments may overcome the above disadvantages and other disadvantages not described above. Also, an exemplary embodiment is not required to overcome the disadvantages described above, and an exemplary embodiment may not overcome any of the problems described above.

One or more exemplary embodiments relate to a door unit capable of controlling folding speed of a portion of a door and a clothes treating apparatus having the same.

One or more exemplary embodiments relate to a door unit that a hinge element is not exposed to the outside and a clothes treating apparatus having the same.

According to an aspect of an exemplary embodiment, there is provided a clothes treating apparatus including a main body in which an internal space configured to receive clothes is formed; and a door unit configured to open and close an opened upper portion of the internal space. The door unit may include a first door rotatably disposed about a first hinge shaft with respect to the main body; a second door coupled to the first door and configured to be rotatable about a second hinge shaft with respect to the first door; and a damper configured to press the second door to a second direction opposite to a first direction in response to the second door being rotated to the first direction with respect to the first door.

The first direction may be a direction that an angle formed through the first door and the second door is increased.

The first hinge shaft may be in parallel to the second hinge shaft.

The damper may include a damper body disposed in the second door; and a damper shaft protruding from the damper body toward the first door.

The first door may include a shaft coupling part coupled to the damper shaft and the second door may include a damper receiving part configured to receive the damper body.

The damper receiving part may protrude toward the internal space in a state that the door unit covers the opened upper portion of the internal space.

The shaft coupling part may protrude toward the internal space in a state that the door unit covers the opened upper portion of the internal space.

The damper may include a pair of dampers disposed symmetrically with each other.

According to an aspect of an exemplary embodiment, there is provided a clothes drying apparatus including a main body in which an internal space configured to receive clothes is formed; a blowing fan configured to supply air to the internal space; a heater configured to heat the air supplied to the internal space; and a door unit configured to open and close an opened upper portion of the internal space. The door unit may include a first door rotatably disposed with respect to the main body; a second door rotatably disposed with respect to the first door; and a damper configured to press the second door to a second direction opposite to a first direction in response to the second door being rotated to the first direction opposite with respect to the first door.

The first direction may be a direction that an angle formed through the first door and the second door is increased.

A rotation axis of the first door may be in parallel to a rotation axis of the second door.

The damper may include a damper body disposed in the second door; and a damper shaft protruding from the damper body toward the first door.

The first door may include a shaft coupling part coupled to the damper shaft and the second door may include a damper receiving part configured to receive the damper body.

The damper receiving part and the shaft coupling part may protrude toward the internal space in a state that the door unit covers the opened upper portion of the internal space.

Additional aspects and advantages of the exemplary embodiments are set forth in the detailed description, and will be obvious from the detailed description, or may be learned by practicing the exemplary embodiments.

BRIEF DESCRIPTION OF THE DRAWING FIGURES

The above and/or other aspects of the present invention will be more apparent by describing certain exemplary embodiments of the present invention with reference to the accompanying drawings, in which.

DETAILED DESCRIPTION OF THE EXEMPLARY EMBODIMENTS

Figure 1:
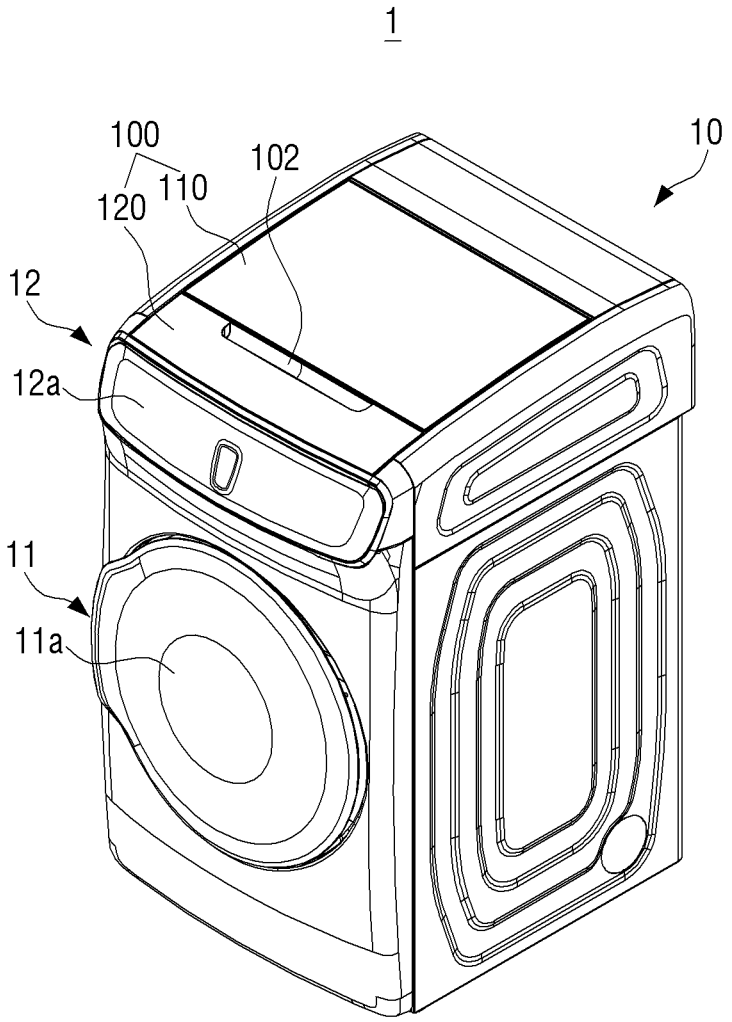
FIGS. 1 and 2 are perspective views illustrating an example that a door unit is mounted on a dryer according to an exemplary embodiment.

Hereinafter, various embodiments will now be described more fully with reference to the accompanying drawings in which some embodiments are shown. The techniques described herein are exemplary, and should not be construed as implying any particular limitation on the present disclosure. It should be understood that various alternatives, combinations and modifications could be devised by those skilled in the art. In the following description, unless otherwise described, the same reference numerals are used for the same elements when they are depicted in different drawings.

It will be understood that, although the terms first, second, etc. may be used herein in reference to elements of the invention regardless of an order and/or importance, such elements should not be construed as limited by these terms. The terms are used only to distinguish one element from other elements. For example, without departing from the spirit of the inventive concept, a first element may refer to a second element, and similarly, the second element may refer to the first element.

It will be further understood that the terms used herein should be interpreted as the meaning defined herein. Unless otherwise defined, all terms including technical and scientific terms used herein have the same meaning as commonly understood by one of ordinary skill in the art to which this inventive concept belongs.

A clothes treating apparatus mounted with a door unit according to an exemplary embodiment will be described. The door unit according to an exemplary embodiment is applicable to a top loading type clothes treating apparatus.

Hereinafter, an example that a door unit is applied to a dryer only having a dry function among clothes treating apparatuses will be described for clarity.

However, this is not limited thereto and the door unit according to an exemplary embodiment is applied to various types of clothes treating apparatuses such as a washing machine other than the dryer through the following exemplary description.

Figure 2:
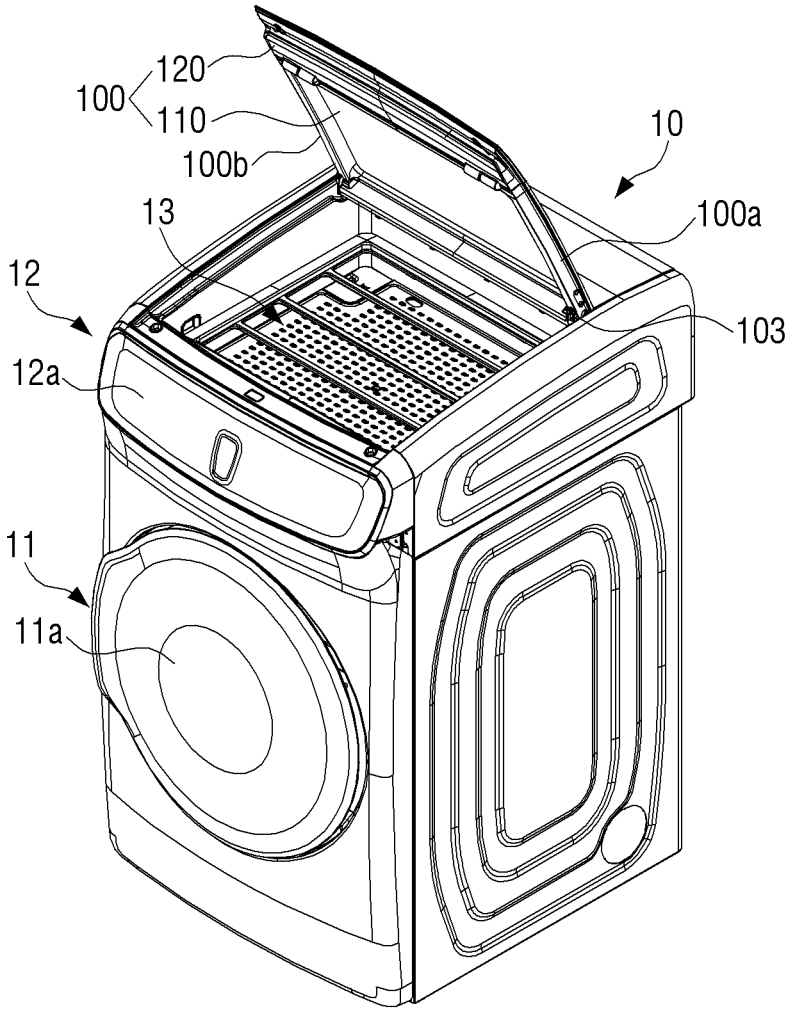

FIGS. 1 and 2 are perspective views illustrating a dryer mounted with a door unit according to an exemplary embodiment, wherein FIGS. 1 and 2 illustrate open and close states of the door unit. The dryer may refer to a clothes dryer.

A dryer 1 according to an exemplary embodiment is divided into a first drying apparatus 11 and a second drying apparatus 12.

The first drying apparatus 11 is located below the second drying apparatus 12 and is a drum type drying apparatus which a drum configured to store clothes is disposed in the inside thereof. As the drum rotates, hot air is applied to the inside of the drum and thus a drying operation is performed. A front door 11*a* is provided in a front portion of the dryer 1 so that clothes are inserted into the first drying apparatus 11 or taken out from the first drying apparatus 11.

The second drying apparatus 12 disposed over the first drying apparatus 11 also includes an internal space (see 13 of FIG. 2) formed in the inside thereof and configured to store clothes.

The second drying apparatus 12 is a top loading type drying apparatus which the internal space 13 thereof having substantially a rectangular parallelepiped shape is formed in the inside of the main body 10 and is configured to dry clothes through hot air supplied to the inside.

Accordingly, the second drying apparatus 12 may include a blowing fan (not shown) configured to supply air to the internal space 13 and a heater (not shown) configured to heat the air supplied to the internal space 13 through the blowing fan.

A control panel 12*a* is mounted on a front portion of the second drying apparatus 12 and the first drying apparatus 11 and the second drying apparatus 12 are controlled through the control panel 12*a*.

In the door unit 100 according to an exemplary embodiment, one end 103 is hinge-coupled to the upper portion of the main body 10 of the second drying apparatus 12.

The user may lift the door unit 100 toward an upper side of the clothes drying apparatus 1 using a handle 102 formed in the door unit 100 and open the internal space 13 of the second drying apparatus 12 as illustrated in FIG. 2.

A rotation groove (see 103*a* of FIG. 7) is formed in the one end 103 of the door unit 100 and the door unit 100 may rotate about the rotation groove 103*a* between an open position (see FIG. 2) and a close position (see FIG. 1).

A slide groove 103*b* is formed in the rotation groove 103*a* so that a hinge shaft (not shown) coupled to the second drying apparatus 12 is slidably coupled to the rotation groove 103*a* and thus the door unit 100 is easily mounted on the second drying apparatus 12.

Hereinafter, a configuration of a door unit according to an exemplary embodiment will be described in detail with reference to FIGS. 3 to 12.

Figure 3:
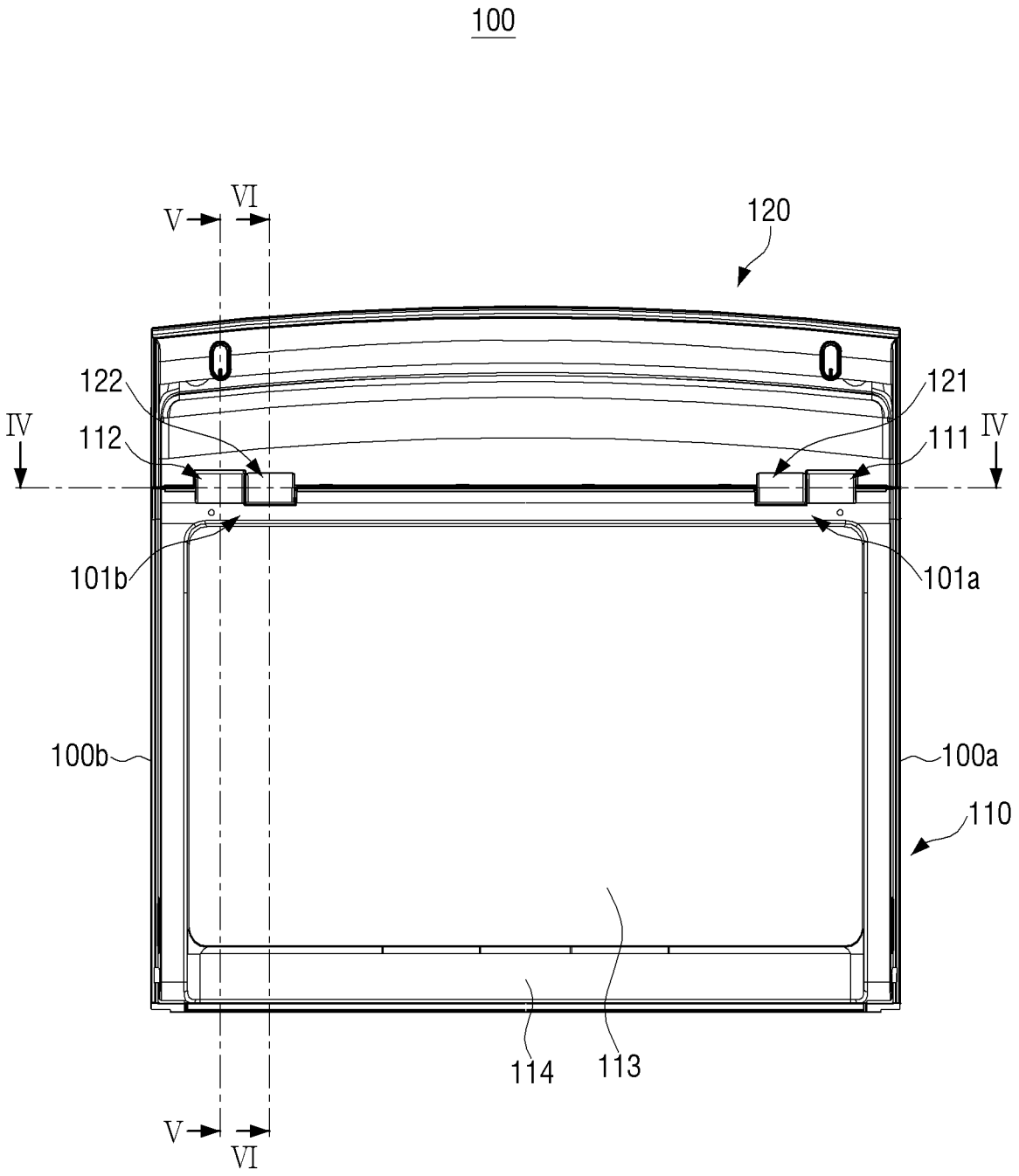
FIG. 3 is a bottom diagram illustrating a door unit according to an exemplary embodiment.
Figure 4:
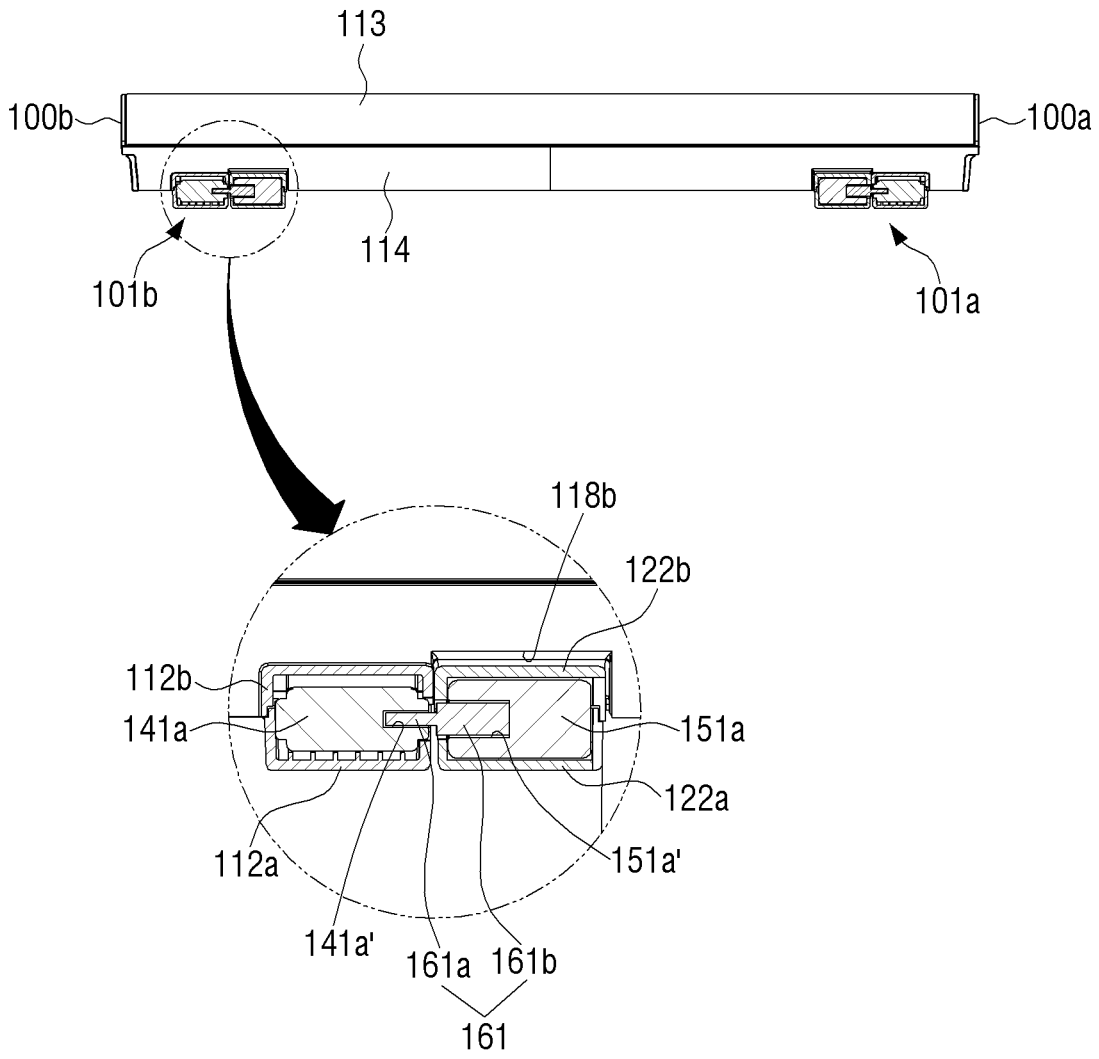
FIG. 4 is a cross-sectional diagram illustrating the door unit taken along line IV-IV of FIG. 3.
Figure 5:
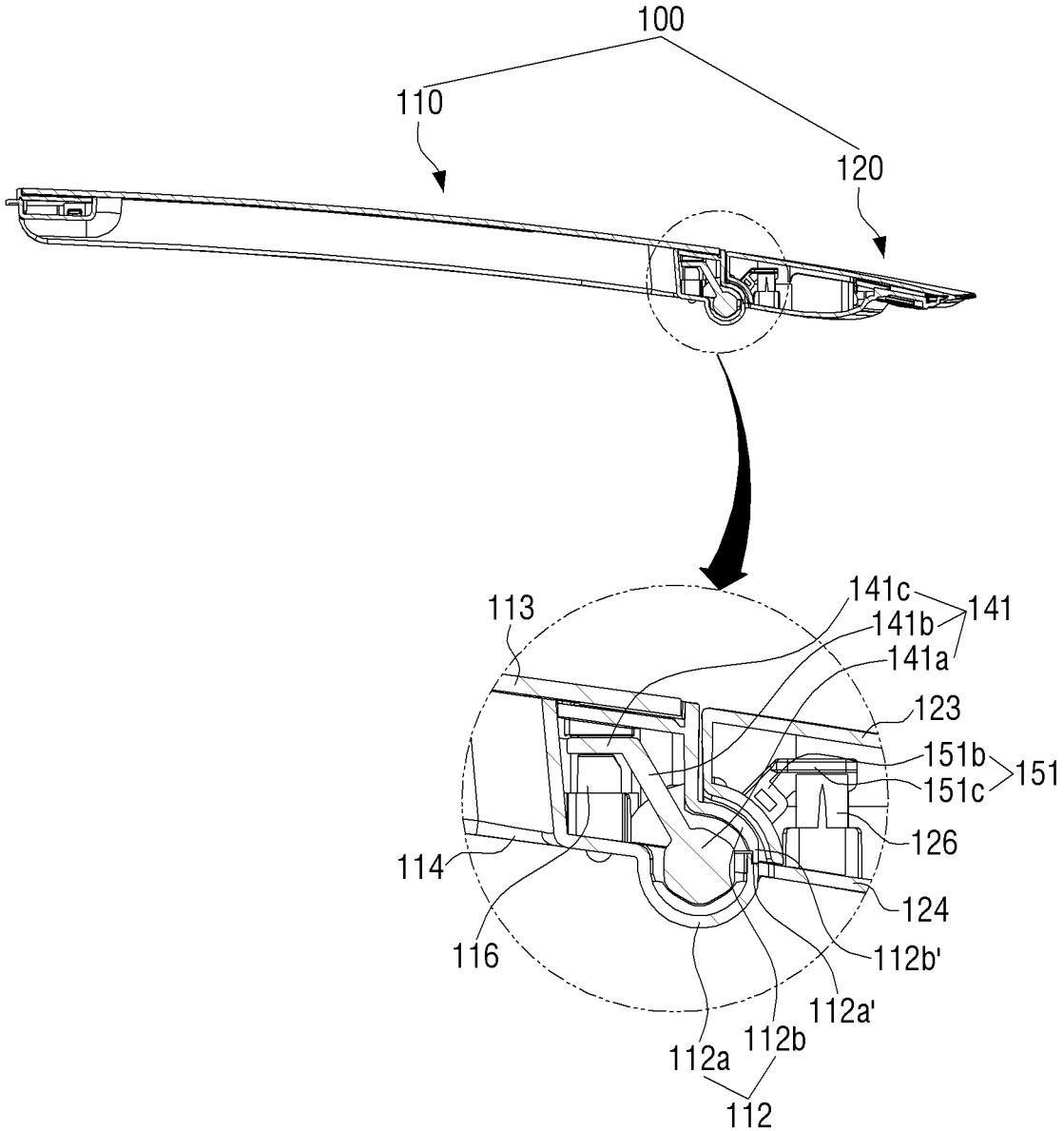
FIG. 5 is a cross-sectional diagram illustrating the door unit taken along line V-V of FIG. 3.
Figure 6:
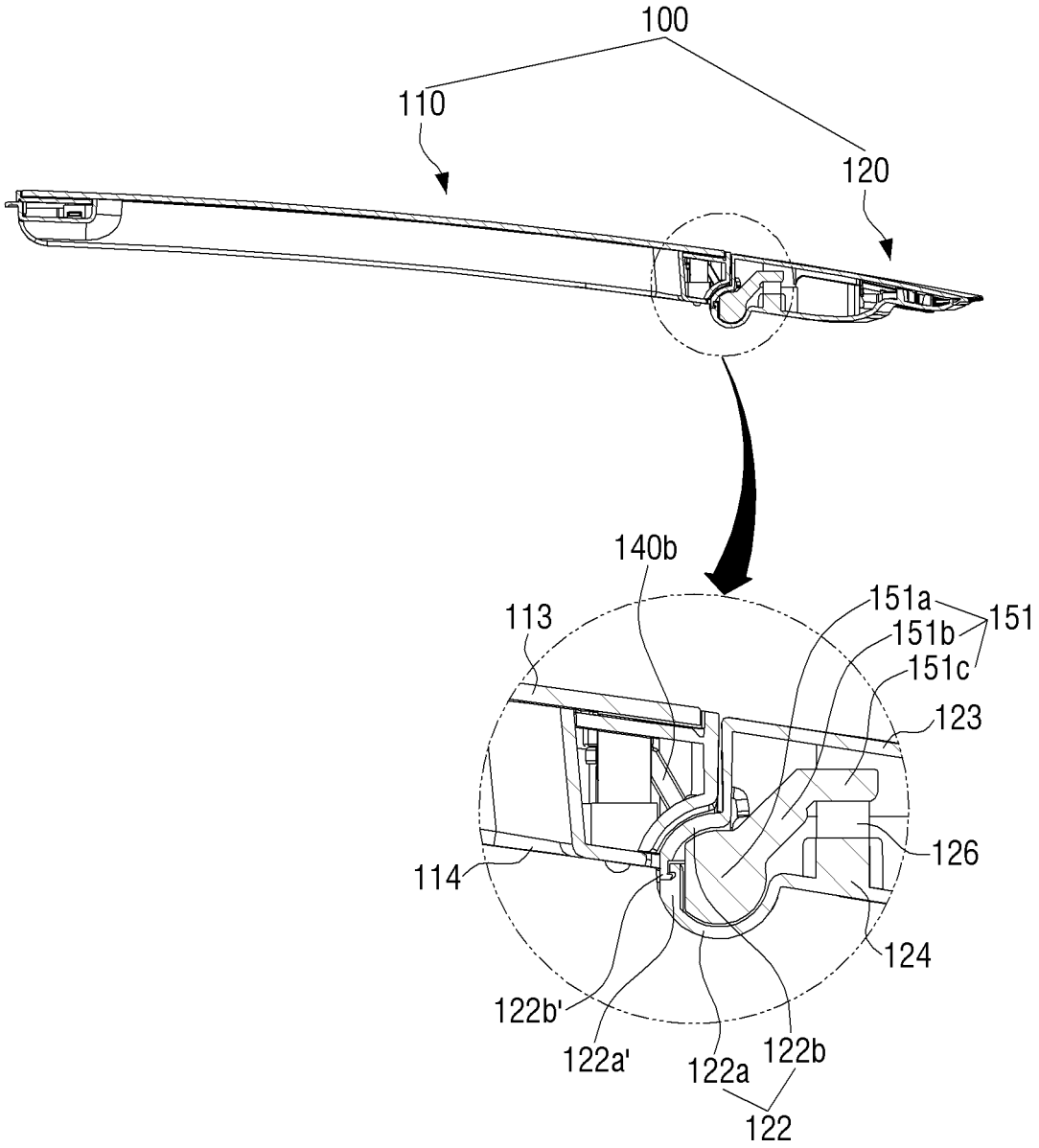
FIG. 6 is a cross-sectional diagram illustrating the door unit taken along line VI-VI of FIG. 3.
Figure 7:
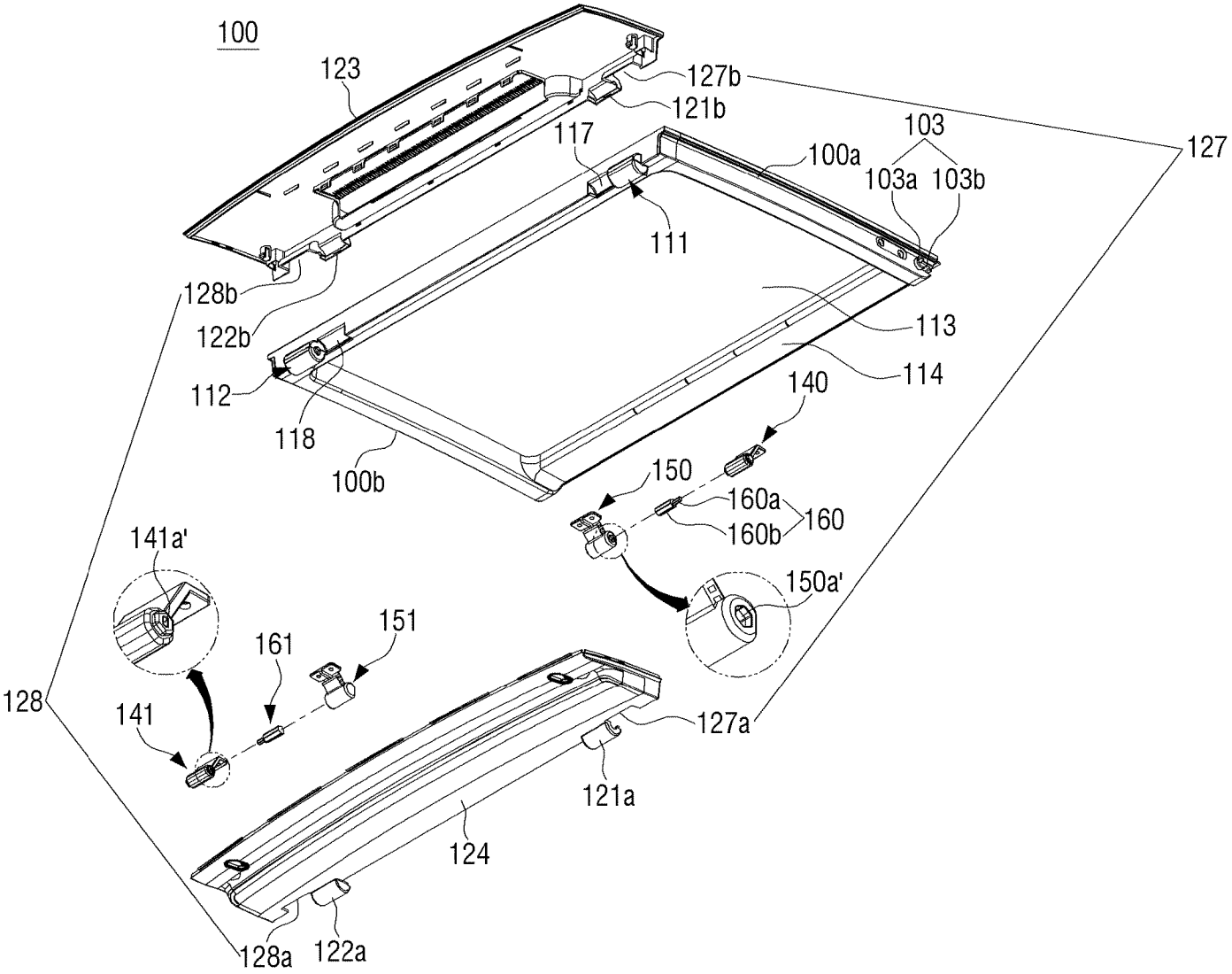
FIGS. 7 and 8 are exploded perspective views illustrating a door unit when viewed in different directions according to an exemplary embodiment.
Figure 8:
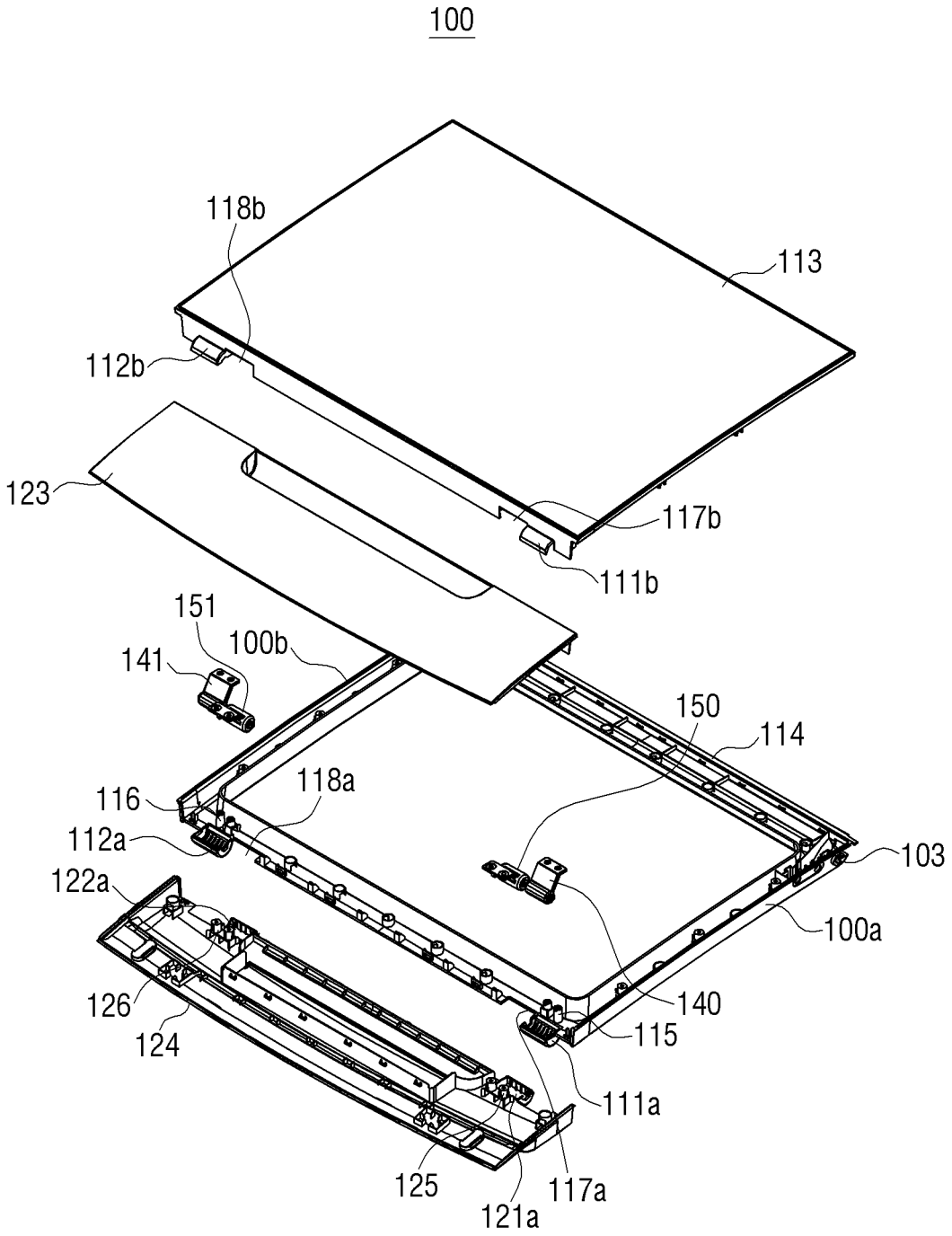

FIG. 3 is a bottom view illustrating a door unit according to an exemplary embodiment, FIG. 4 is a cross-sectional diagram illustrating the door unit taken along line IV-IV of FIG. 3, and FIG. 5 is a cross-sectional diagram illustrating the door unit taken along line V-V of FIG. 3, and FIG. 6 is a cross-sectional diagram illustrating the door unit taken along line VI-VI of FIG. 3. FIGS. 7 and 8 are exploded perspective views illustrating a door unit when viewed in different directions according to an exemplary embodiment and FIGS. 9 to 12 are diagrams illustrating operation states of a second door of a door unit according to an exemplary embodiment.

Referring to FIG. 3, the door unit 100 according to an exemplary embodiment is configured of a first door 110 and a second door 120.

Referring to FIGS. 7 and 8, the first door 110 is formed by coupling a first door top frame 113 and a first door bottom frame 114.

As illustrated in FIG. 8, a plurality of bosses 116 which are configured to screw-couple or rivet-couple the first door top frame 113 and the first door bottom frame 114 are formed in the first door bottom frame 114. However, the coupling between the first door top frame 113 and the first door bottom frame 114 is not limited thereto and the first door top frame 113 is snap-coupled to the first door bottom frame 114.

The rotation groove 103*a* is formed in the one end 103 of the first door 110 and the first door 110 is hinge-coupled to the upper portion of the main body 10 of the second drying apparatus 12. The first door 110 is rotatable about a first hinge shaft formed by the rotation groove 103*a*.

The first door 110 is rotatable about the first hinge shaft to a first door opening direction and a first door closing direction.

The second door 120 is hinge-coupled to the other end (see 110*a* of FIG. 12) of the first door through a pair of hinge parts 101*a* and 101*b*.

The pair of hinge parts 101*a* and 101*b* form a second hinge shaft and the second door 120 is rotatable about the second hinge shaft with respect to the first door.

The first hinge shaft is in parallel to the second hinge shaft.

The second door 120 is rotatable to a first direction and a second direction.

Figure 9:
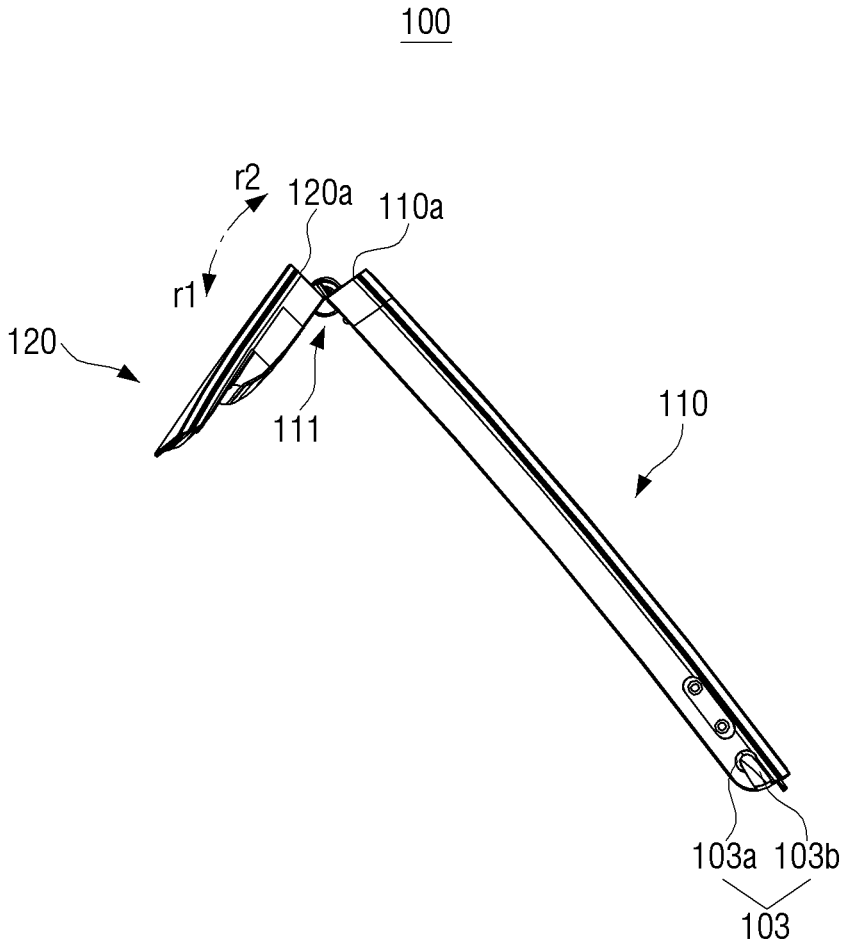
FIGS. 9 to 12 are diagrams illustrating operation states of a second door of a door unit according to an exemplary embodiment.
Figure 10:
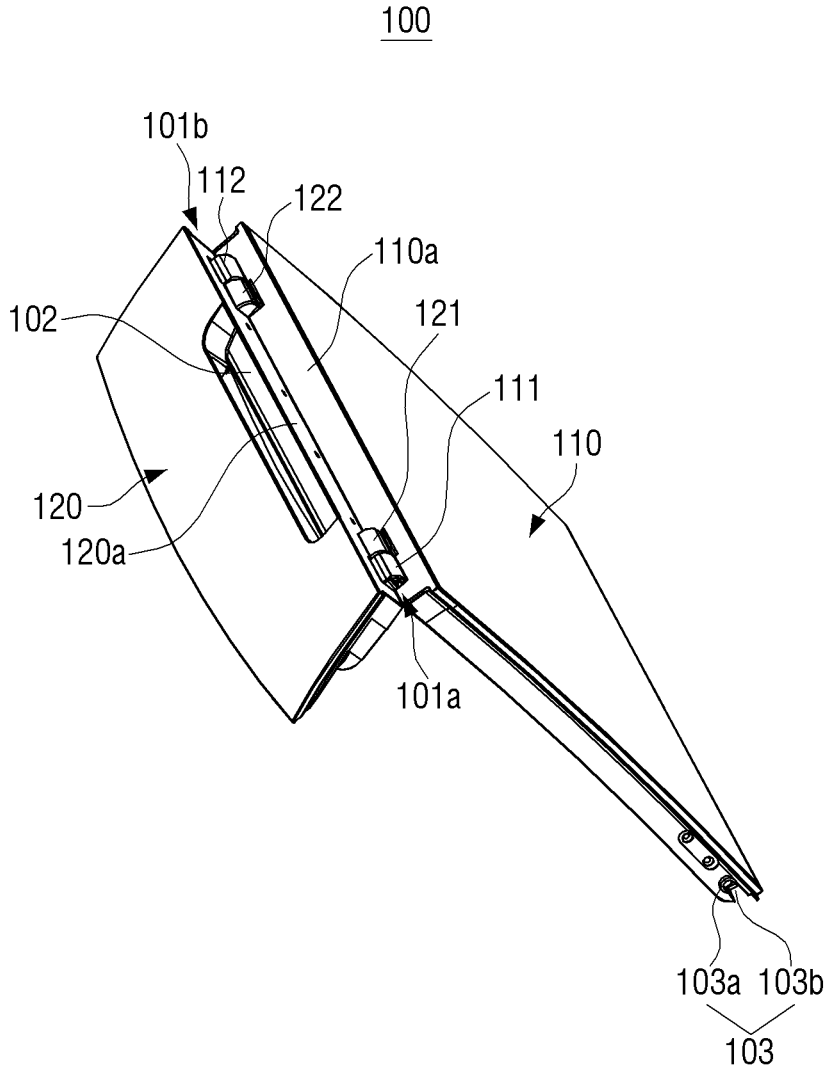
Figure 11:
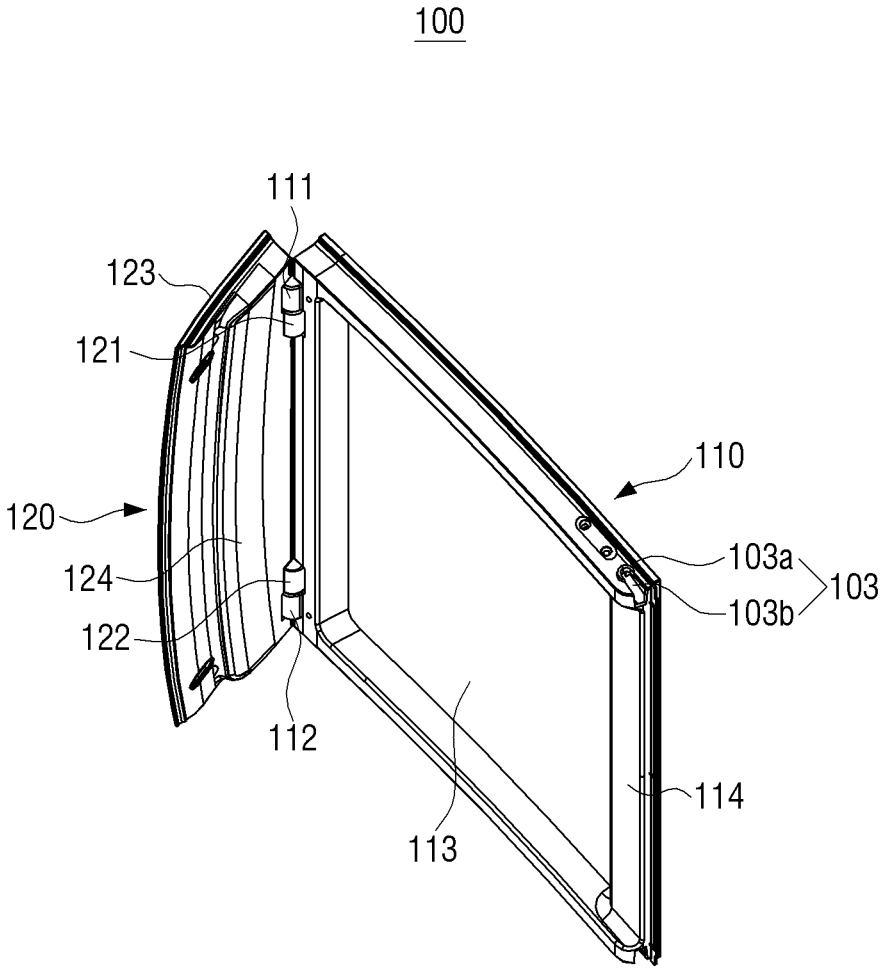

Here, the first direction is a direction that an angle formed by the first door 110 and the second door 120 is increased. Referring to FIG. 9, the first direction refers to an r2 direction.

The second direction is an opposite direction to the first direction and the second direction is a direction that the angle formed by the first door 110 and the second door 120 is reduced. Referring to FIG. 9, the second direction refers to an r1 direction.

One hinge part 101*a* of the pair of hinge parts 101*a* and 101*b* is disposed close to a left side 100*a* of the door unit and the other hinge part 101*b* is disposed close to a right side 100*b* of the door unit.

However, one of the pair of the hinge parts 101*a* and 101*b* may be formed in the center of the other end 110*a* of the first door and the center of one end of the second door. Both of the pair of hinge parts may be formed in the center of the other end of the first door and the center of the one end of the second door.

Further, the first and second doors are couplable through one hinge part. In this case, the one hinge part is formed in the center of the other end of the first door and the center of the one end of the second door.

The user grips the handle 102 formed in the second door 120 and pulls the handle upward and thus the second door 120 is lifted up.

Figure 12:
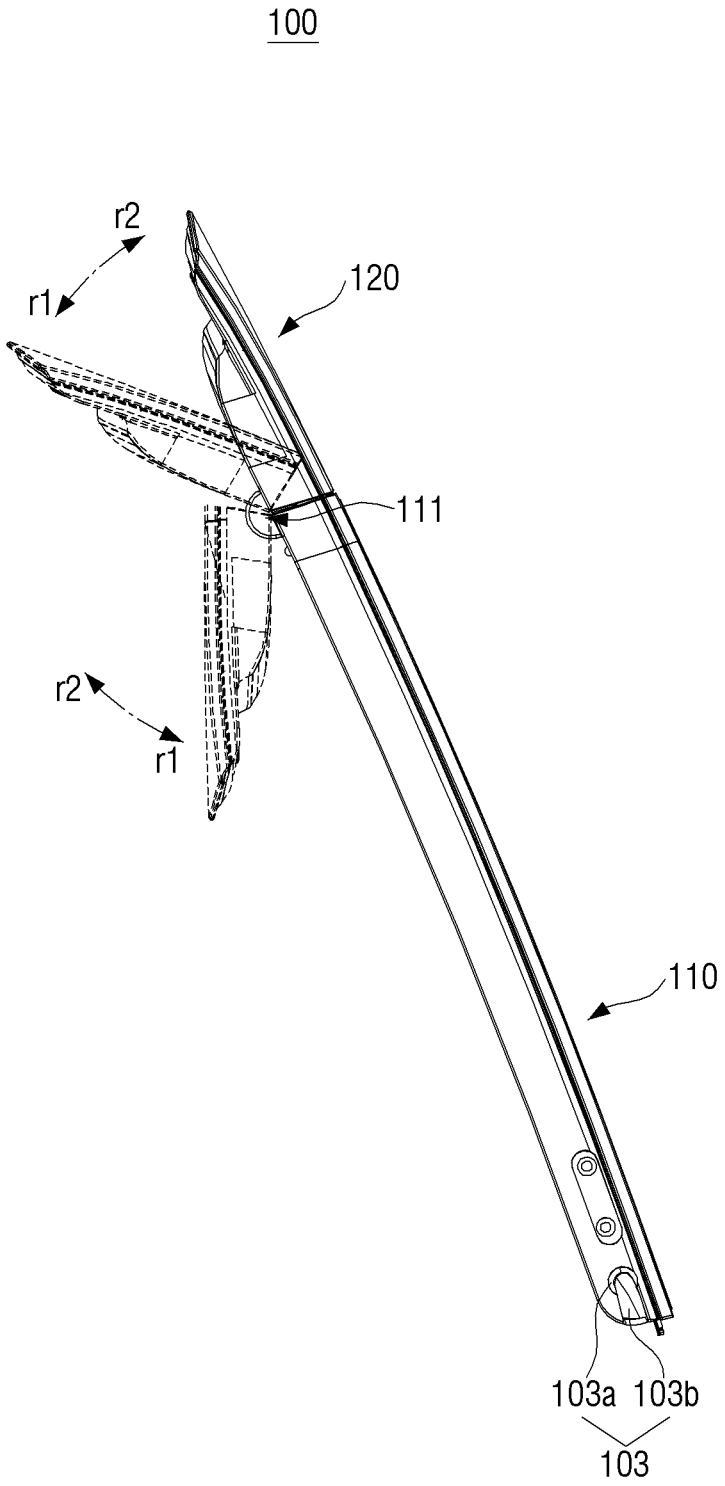

The first door 110 rotates about the rotation groove 103*a* toward the upper side of the dryer 1 (see FIG. 12). The second door 120 rotates to the same direction as the first door 110, this is, the first direction (see the r2 direction of FIG. 12) in a state that the one end 120*a* of the second door is in contact with the other end 110*a* of the first door.

In response to the first door 110 being rotated at a fixed angle or more, the hand of the user is far away from the handle 102 formed in the second door 120 in a state that the arm of the user is fully stretched. At this time, the second door 120 smoothly rotates to the r1 direction (that is, the second direction) so that the handle 102 is not missed by the hand of the user even in the state that the arm of the user is fully stretched.

Accordingly, the door unit 100 according to an exemplary embodiment is configured to allow the second door 120 to rotate to the opposite direction to the rotation direction of the first door 100.

Referring to FIGS. 7 and 8, to press the second door 120 to the second direction opposite to the first direction in response to the second door 120 being rotated to the first direction with respect to the first door, the pair of hinge parts 101*a* and 101*b* include a plurality of shaft coupling parts 111 and 112, a plurality of damper receiving parts (see 121 and 122 of FIG. 3), a plurality of first hinge elements 140 and 141 fixed to the first door and disposed in the shaft coupling parts, a plurality of second hinge elements 150 and 151 fixed to the second door and disposed in the damper receiving parts, and a plurality of dampers 160 and 161 configured to couple the first and second hinge elements and disposed coaxially with the first and second hinge elements.

Hereinafter, the pair of hinge parts 101*a* and 101*b* and the plurality of shaft coupling parts 111 and 112 and the plurality of damper receiving parts 121 and 122 in which the hinge elements are accommodated will be described in detail with reference to FIGS. 4 to 8.

FIG. 4 is a cross-sectional diagram illustrating an arrangement of the shaft coupling part 112, the damper receiving part 122, the first hinge element 141, the second hinge element 151, and the damper 161 which are included in any one hinge part 101*b* of the pair of hinge parts 101*a* and 101*b*. The other hinge part 101*a* may have the same arrangement as the one hinge part 101*b* or may have a symmetrical arrangement with the one hinge part 101*a*.

FIGS. 7 and 8 illustrate the first and second doors 110 and 120 in an exploded manner and as the first door is divided into the top and bottom frames 113 and 114, the plurality of shaft coupling parts 111 and 112 are divided into upper portions 111*b* and 112*b* and lower portions 111*a* and 112*a*. As the second door is divided into the top and bottom frames 123 and 124, the plurality of damper receiving parts 121 and 122 are also divided into upper portions 121*b* and 122*b* and lower portions 121*a* and 122*a*.

For clarity, the arrangement structure of elements included in the hinge part will be described only on the basis of one hinge part 101*b* and it can be understood that the configuration of the other hinge part 101*b* is the same as that of the one hinge part 101*a* to be described below or has the symmetrical structure with the one hinge part.

Referring to FIGS. 4 and 5, the first hinge element 141 includes a hinge body 141*a*, an extension portion 141*b* formed to extend from the hinge body, and a fixing portion 141*c* extending from the extension portion to be bended to a certain angle.

The hinge body 141*a* of the first hinge element is disposed in the shaft coupling part 112 formed to extend from the other end 110*a* of the first door 110.

The hinge body 141*a* may substantially have a cylindrical shape to match with the internal shape of the shaft coupling part 112. However, the shape of the hinge body 141*a* is not limited to the cylindrical shape and the hinge body 141*a* may have a hexagonal column shape to prevent the hinge body 141*a* from shaking or moving in the inside of the shaft coupling part 112.

The shaft coupling part 112 is configured of the upper portion 112*b* and the lower portion 112*a*. The upper portion 112*b* is formed to extend from the top frame 113 of the first door and the bottom portion 112*a* is formed to extend from the bottom frame 114 of the first door.

Coupling joints (see 112*b*' and 112*a*' of FIG. 5) are formed in the upper portion 112*b* and the lower portion 112*a* of the shaft coupling part and in response to the top frame 113 and the bottom frame 114 being coupled, the coupling joints 112*b*' and 112*a*' are engaged with each other and the top frame 113 and the bottom frame 114 are snap-coupled to each other.

Accordingly, no separate part for screw-coupling or rivet-coupling to form the shaft coupling part 112 is required.

The extending portion 141*b* of the first hinge element is formed to extend from the hinge body 141*a* to a certain slope. This is to place the fixing portion 141*c*, which is formed to be bended to a certain angle from the extension portion 141*b* of the first hinge element, in a top surface of the boss 116 formed in the bottom frame 114.

The fixing portion 141*c* is screw-coupled to the boss 116 in the top surface of the boss 116.

Accordingly, the hinge body 141*a* of the first hinge element is fixed to the boss 116 formed in the first door through the extension portion 141*b* and the fixing portion 141*c*.

Referring to FIG. 6, the second hinge element 151 includes a hinge body 151*a*, an extension portion 151*b* formed to extend from the hinge body, and a fixing portion 151*c* extending from the extension portion to be bended to a certain angle.

The hinge body 151*a* of the second hinge element is disposed in the damper receiving part 122 formed to extend from the one end 120*a* of the second door.

The hinge body 151*a* may substantially have a cylindrical shape to match with the internal shape of the damper receiving part 122. However, the shape of the hinge body 151*a* is not limited to the cylindrical shape. As illustrated in the cross-sectional view of FIG. 6, the hinge body 151*a* may be formed so that a portion of the hinge body has a flat surface and the remaining portion has a cylindrical shape to prevent the hinge body 151*a* from shaking or moving in the inside of the damper receiving part 122.

The damper receiving part 122 is configured of the upper portion 122*b* and the lower portion 122*a*. The upper portion 122*b* is formed to extend from the top frame 123 of the second door and the lower portion 122*a* is formed to extend from the bottom surface 124 of the second door.

Coupling joints 122*b*' and 122*a*' are formed in the upper portion 122*b* and the lower portion 122*a* of the damper receiving part and in response to the top frame 123 and the bottom frame 124 being coupled, the coupling joints 122*b*' and 122*a*' may be engaged with each other and the top frame 123 and the bottom frame 124 are snap-couplable to each other.

Accordingly, no separate part for screw-coupling or rivet-coupling to form the damper receiving part 122 is required.

The extension portion 151*b* of the second hinge element is formed to extend from the hinge body 151*a* at a certain slope. This is to place the fixing portion 151*c*, which is formed to be bended to a certain angle from the extension portion 151*b* of the second hinge element, in a top surface of a boss 126 formed in the bottom frame 124.

The fixing portion 151*c* is screw-coupled to the boss 126 in the top surface of the boss 126.

Accordingly, the hinge body 151*a* of the second hinge element is fixed to the boss 126 formed in the second door through the extension portion 151*b* and the fixing portion 151*c*.

The shaft coupling part 112 and the damper receiving parts 122 is coaxially disposed closed to each other. The shaft coupling part 112 is disposed closer to the left side 100*b* of the door unit than the damper receiving part 122. However, the arrangement of the shaft coupling part 112 and the damper receiving parts 122 is not limited thereto and the damper receiving part 122 is disposed closer to the left side 100*b* of the door unit than the shaft coupling part 112.

The damper 161 includes a damper body 161*b* disposed in the second door 120 and a damper shaft 161*a* protruding toward the first door 110 from the damper body 161*b*.

The damper 161 is disposed coaxially with the hinge bodies 141*a* and 151*a* of the first and second hinge elements and couples the hinge bodies 141*a* and 151*a* of the first and second hinge elements.

Specifically, the damper shaft 161*a* is coupled to a first hole 141*a*' formed in the hinge body of the first hinge element and the damper body 161*b* is accommodated in a second hole 151*a*' formed in the hinge body of the second hinge element.

The damper 161 is typically a hydraulic type damper and the damper shaft 161*a* is configured to be rotatable about a longitudinal axis of the damper 161 to the r1 and r2 directions of FIG. 9 with respect to the damper body 161*b*.

The damper shaft 161*a* has certain rotation torque through fluid contained in the damper body 161*b*.

The damper 161 presses the second door 120 to the second direction (the r1 direction) opposite to the first direction (the r2 direction) due to the rotation torque of the damper shaft 161*a* in response to the second door 120 being rotated to the first direction (the r2 direction) with respect to the first door.

The rotation torque of the damper shaft 161*a* is variously set and is not be limited to a certain level.

The first hinge element 141 and the second hinge element 151 are disposed in the shaft coupling part 112 and the damper receiving part 122.

The plurality of first hinge elements 140 and 141 and the plurality of second hinge elements 150 and 151 are disposed in the insides of the plurality of shaft coupling parts 111 and 112 and the plurality of damper receiving parts 121 and 122 and thus the plurality of first hinge elements 140 and 141 and the plurality of second hinge elements 150 and 151 are not observed from the outside.

The shaft coupling part 112 is inserted into and disposed in a groove (see 128 of FIG. 7) formed in one end of the second door so that the first hinge element 141 rotates regardless of the rotation direction of the second hinge element 151. On the contrary, the damper receiving part 122 is inserted into and disposed in a groove (see 118 of FIG. 7) formed in the other end of the first door 110 so that the second hinge element 151 rotates regardless of the rotation direction of the first hinge element 141.

Referring to FIGS. 7 and 8, the other shaft coupling part 111 is inserted into and disposed in a groove 127 formed in the one end of the second door 120 and the other damper receiving part 121 is inserted into and disposed in a groove 117 formed in the other end of the first door 110 so that the other shaft coupling part 111 and the other damper receiving part 121 have a symmetrical structure with the one shaft coupling part 112 and the one damper receiving part 122.

The at least one or more grooves 117 and 118 formed in the other end of the first door 110 are divided into upper grooves 117*b* and 118*b* and lower grooves 117*a* and 118*a* through the top frame 113 and the bottom frame 114 of the first door. In response to the top frame 113 and the bottom frame 114 of the first door being coupled to each other, the upper grooves 117*b* and 118*b* and the lower grooves 117*a* and 118*a* are coupled to form the grooves 117 and 118.

The plurality of grooves 127 and 128 formed in the one end of the second door 120 are divided into upper grooves 127*b* and 128*b* and lower grooves 127*a* and 128*a* through the top frame 123 and the bottom frame 124 of the second door. In response to the upper frame 123 and the bottom frame 124 of the second door being coupled to each other, the upper grooves 127*b* and 128*b* and the lower grooves 127*a* and 128*a* are coupled to form the grooves 127 and 128.

The plurality of shaft coupling parts 111 and 112 and the plurality of damper receiving parts 121 and 122 are insert into and disposed in the plurality of grooves 117 and 118 and 127 and 128 and thus the plurality of shaft coupling parts 111 and 112 and the plurality of damper receiving parts 121 and 122 are also not observed from the outside in response to the door unit 100 being in a close position (see FIG. 1).

In response to the opened upper portion of the internal space 13 of the main body 10 being covered with the door unit 100, the plurality of shaft coupling parts 111 and 112 and the plurality of damper receiving parts 121 and 122 protrude toward the internal space 13.

In response to the shaft coupling parts 111 and 112 and the damper receiving parts 121 and 122 being formed to protrude more than the upper frames 113 and 123 of the first and second doors, a protruding portion is formed in an outer surface of the door unit 100 when viewed from the outside of the dryer 1 and thus it is difficult to form a smooth body line.

Accordingly, in response to the shaft coupling parts 111 and 112 and the damper receiving parts 121 and 122 being formed to protrude more than the bottom frames 114 and 124 of the first and second doors, the shaft coupling parts 111 and 112 and the damper receiving parts 121 and 122 are not observed from the outside of the dryer 1 and thus the dryer 1 may provide a simple impression.

Even in response to an overall thickness of the door unit 100 being reduced to lighten the door unit 100 and reduce the material cost for manufacturing the door unit 100, a smooth body line of the dryer 1 is maintained and the aesthetic sense in the dryer 1 is obtained in response to the plurality of shaft coupling parts 111 and 112 and the plurality of damper receiving parts 121 and 122 being formed to protrude more than the bottom frames 114 and 124 of the first and second doors.

At least two or more hinge parts 101*a* and 101*b* according to an exemplary embodiment are covered with at least two or more shaft coupling parts 111 and 112 and at least two or more damper receiving parts 121 and 122 formed to extend in the other end 110*a* of the first door and the one end 120*a* of the second door which face each other and thus the dyer may give a structurally simple and neat impression in external appearance to the user.

Hereinafter, an operation of a door unit according to an exemplary embodiment will be described with reference to FIGS. 9 to 12.

In response to the handle 102 formed in the top surface of the second door 120 being griped and lifted up through the user, the second door 120 is pulled upward through the user and the first door 110 rotates about the rotation groove 103*a* to the r2 direction (see FIG. 12). The second door 120 rotates to the same direction (the r2 direction of FIG. 12) as the first door 110 in a state that the one end 120*a* of the second door is in contact with the other end 110*a* of the first door.

However, in response to the first door 110 being rotate at a certain angle or more to the r2 direction, the arm of the user is fully stretched and the second door 120 is not pulled upward anymore by the user.

In this example, the second door 120 rotates to the opposite direction (the r1 direction) to the rotation direction (the r2 direction) of the first door 110.

The rotation speed of the second door 120 is lower than that of the folder type door having no damper in the related art due to the plurality of dampers 160 and 161. Accordingly, the user has a feeling that the operation of the door unit 100 is luxurious due to the smooth movement of the second door 120 in the opening of the door unit 100.

In response to the first door 110 reaching a position that the inside of the main body 10 is completely opened, the second door 120 rotates to the r1 direction through gravity or the griping operation of the handle 102 by the user and is in perpendicular to the ground.

In general, a locking part (not shown) configured to prevent the first door 110 from being automatically rotated to the r1 direction through the gravity is installed in the first door 110 and thus the first door 110 may not rotate to the r1 direction in a completely opened position.

The user pulls or pushes the door unit 100 to the r1 direction and thus the user closes the door unit 100.

In response to the first door 110 being rotated to the r1 direction at a certain angle or more, the second door 120 rotates to the r2 direction through the rotation torques of the damper shafts 160*a* and 161*a* generated by the fluid pressure in the plurality of dampers 160 and 161.

The rotation speed of the second door 120 is lower than that of the folder type door having no damper in the related art due to the plurality of dampers 160 and 161. Accordingly, the user has a feeling that the operation of the door unit 100 is luxurious due to the smooth movement of the second door 120 even in the closing of the door unit 100.

Before the first door 110 reaches a completely closed position, the second door 120 continuously rotates to the r2 direction through the rotation torques of the damper shafts 160*a* and 161*a*. The one end 120*a* of the second door is in contact with the other end 110*a* of the first door and the shaft coupling parts 111 and 112 and the damper receiving part 121 and 122 are covered.

Accordingly, the shaft coupling parts 111 and 112 and the damper receiving parts 121 and 122 may not be overserved from the outside.

The one end 120*a* of the second door is in contact with the other end 110*a* of the first door so that the closing speed of the door unit 100 is lower than the closing speed of a general door other than the folder type door. Accordingly, the first and second doors 110 and 120 may not collide with the main body 10 of the second drying apparatus at a fast speed and thus the noise occurrence is prevented and the trapping of the hand of the user or clothes between the door unit 100 and the main body 10 is prevented.

In particular, the shaft coupling parts 111 and 112 and the damper receiving parts 121 and 122 are completely covered with the top frame 113 of the first door and the top frame 123 of the second door in a position that the door unit 100 is completely closed and thus the shaft coupling parts 111 and 112 and the damper receiving parts 121 and 122 are not be observed from the outside and the configuration of the door unit 100 is seemed to be simple in external appearance.

The door unit 100 according to an exemplary embodiment may give a neat impression in the design and may arouse the mental aesthetic sense from the overall unified design concept.

The door unit according to an exemplary embodiment is applicable to a top loading type washing machine. Hereinafter, description for a door unit having the same configuration as the door unit according to an exemplary embodiment will be omitted and an example that the door unit is applied to a washing machine will be described.

Figure 13:
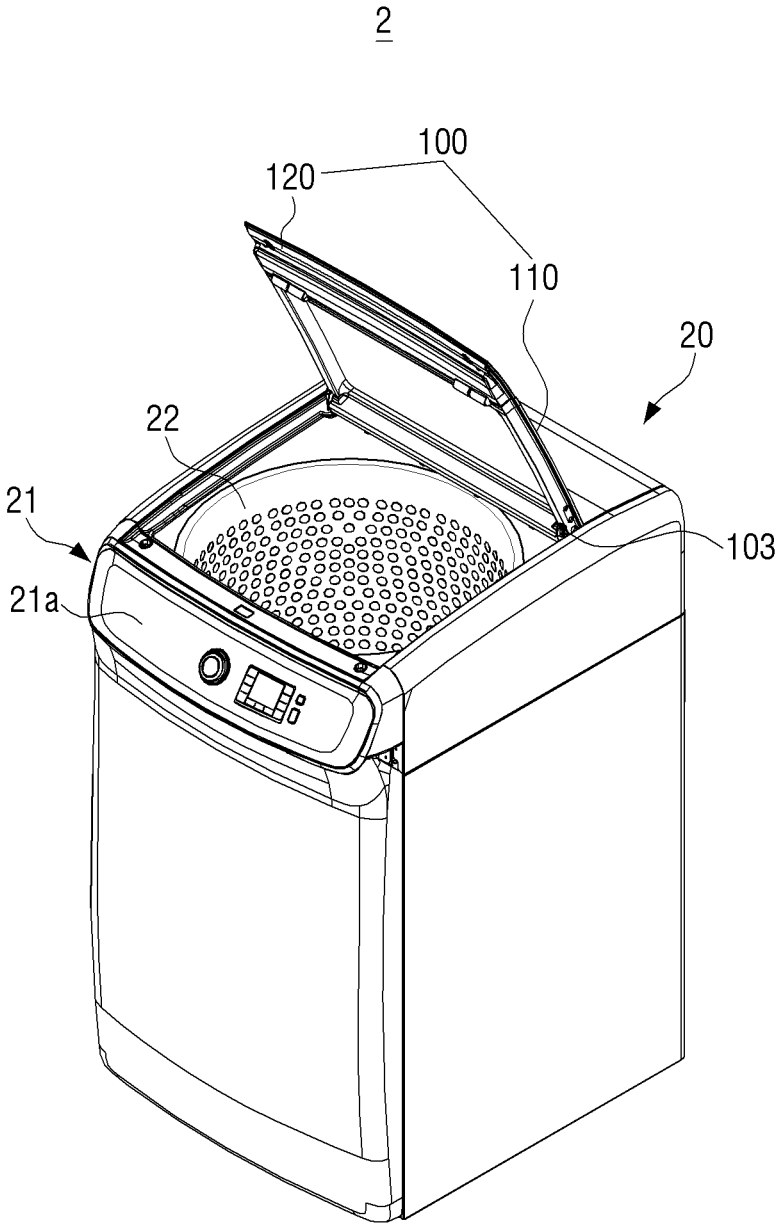
FIG. 13 is a perspective view illustrating an example that a door unit is mounted on a washing machine according to another exemplary embodiment.

FIG. 13 illustrates a washing machine employing the door unit according to an exemplary embodiment.

A washing machine 2 is configured of a main body 20 and a control panel 21*a* may be formed in a front part 21.

A clothes receiving part 22 is disposed in the inside of the main body 20 of the washing machine 2 and the clothes receiving part 22 may be configured of a pulsator or an inner tube.

The one end 103 of the door unit 100 according to an exemplary embodiment is hinge-coupled to an upper portion of the main body 20.

In response to the door unit 100 being opened, the clothes receiving part 22 formed in the inside of the main body 20 is opened.

The door unit 100 is configured of the first door 110 and the second door 120 and the first and second door 110 and 120 is coupled to be rotatable to opposite directions through the hinge parts 101*a* and 101*b*.

The first door 110 is rotatable about a first rotation axis and the second door 120 is rotatable about a second rotation axis. The first rotation axis is in parallel to the second rotation axis.

The second door 120 is rotatable to the first direction and the second direction.

The first direction is a direction that an angle formed through the first door 100 and the second door 120 is increased and the second direction is an opposite direction to the first direction.

The door unit 100 accommodates the first hinge elements 140 and 141 and the second hinge elements 150 and 151 in the insides of the shaft coupling parts 111 and 112 and the damper receiving parts 121 and 122 and thus the hinge elements are not observed from the outside.

The one end 120*a* of the second door is in contact with the other end 110*a* of the first door in a state that the door unit 100 is completely closed and the shaft coupling parts 111 and 112 and the damper receiving parts 121 and 122 are covered and are not exposed to the outside.

Accordingly, in the washing machine 2 installed with the door unit 100 according to an exemplary embodiment, since the hinge element is not be observed from the outside, the simple aesthetic sense in the design is obtained.

The foregoing exemplary embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A clothes treating apparatus comprising:

a main body in which an internal space configured to receive clothes is formed; and a door unit configured to open and close an opened upper portion of the internal space, wherein the door unit includes:

a first door rotatably disposed about a first hinge shaft with respect to the main body;

a second door coupleable to the first door and while coupled, the second door being configured to be rotatable about a second hinge shaft with respect to the first door; and a damper configured to apply a pressure to the second door in a second direction opposite to a first direction in response to the second door being rotated in the first direction with respect to the first door.

2. The clothes treating apparatus as claimed in claim 1, wherein while the second door is being rotated in the first direction an angle between the first door and the second door is increased.

3. The clothes treating apparatus as claimed in claim 1, wherein the first hinge shaft is in parallel to the second hinge shaft.

4. The clothes treating apparatus as claimed in claim 1, wherein the damper includes:

a damper body disposed in the second door; and a damper shaft protruding from the damper body toward the first door.

5. The clothes treating apparatus as claimed in claim 4, wherein the first door includes a shaft coupling part coupled to the damper shaft, and the second door includes a damper receiving part configured to receive the damper body.

6. The clothes treating apparatus as claimed in claim 5, wherein the damper receiving part protrudes toward the internal space in a state that the door unit covers the opened upper portion of the internal space.

7. The clothes treating apparatus as claimed in claim 5, wherein the shaft coupling part protrudes toward the internal space in a state that the door unit covers the opened upper portion of the internal space.

8. The clothes treating apparatus as claimed in claim 1, wherein the damper includes a pair of dampers disposed symmetrically with each other.

9. A clothes drying apparatus comprising:

a main body in which an internal space configured to receive clothes is formed;

a blowing fan configured to supply air to the internal space;

a heater configured to heat the air supplied to the internal space; and a door unit configured to open and close an opened upper portion of the internal space, wherein the door unit includes:

a first door rotatably disposed with respect to the main body;

a second door rotatably disposed with respect to the first door; and a damper configured to apply a pressure to the second door in a second direction opposite to a first direction in response to the second door being rotated to the first direction opposite with respect to the first door.

10. The clothes drying apparatus as claimed in claim 9, wherein while the second door is being rotated in the first direction an angle between the first door and the second door is increased.

11. The clothes drying apparatus as claimed in claim 9, wherein a rotation axis of the first door is in parallel to a rotation axis of the second door.

12. The clothes drying apparatus as claimed in claim 9, wherein the damper includes:

a damper body disposed in the second door; and a damper shaft protruding from the damper body toward the first door.

13. The clothes drying apparatus as claimed in claim 12, wherein the first door includes a shaft coupling part coupled to the damper shaft, and the second door includes a damper receiving part configured to receive the damper body.

14. The clothes drying apparatus as claimed in claim 13, wherein the damper receiving part and the shaft coupling part protrude toward the internal space in a state that the door unit covers the opened upper portion of the internal space.

15. The clothes drying apparatus as claimed in claim 9, wherein the damper includes a pair of dampers disposed symmetrically with each other.

* * * * *